US006311662B1

(12) United States Patent
Calhoun

(10) Patent No.: US 6,311,662 B1
(45) Date of Patent: Nov. 6, 2001

(54) DRIVE ADAPTER FOR A GENERATOR/ MAGNETO

(76) Inventor: Earl H. Calhoun, 220 S. Columbia St., Gastonia, NC (US) 28054

( * ) Notice: Subject to any disclaimer, the term of this patent is extended or adjusted under 35 U.S.C. 154(b) by 0 days.

(21) Appl. No.: 09/583,002

(22) Filed: May 26, 2000

(51) Int. Cl.[7] ..... F02P 1/00
(52) U.S. Cl. ..... 123/149 C; 123/599; 123/406.56
(58) Field of Search ..... 123/406.56, 149 A, 123/149 C, 599

(56) References Cited

U.S. PATENT DOCUMENTS

| | | | | |
|---|---|---|---|---|
| 3,893,439 | * | 7/1975 | Chudoba | 123/149 R |
| 4,120,277 | * | 10/1978 | Ehlen | 123/148 |
| 5,704,338 | * | 1/1998 | Andersson et al. | 123/599 |
| 5,829,422 | * | 11/1998 | Deeds et al. | 123/599 |

* cited by examiner

*Primary Examiner*—Bibhu Mohanty
(74) *Attorney, Agent, or Firm*—Dougherty & Clements LLP

(57) ABSTRACT

A drive adapter which adjusts the timing of an automotive generator/magneto ("magneto")for use with a two cylinder motorcycle engine. The drive adapter has a rotor shaft which connects to the crankshaft of a motorcycle engine. The rotor shaft is connected, in a eccentric relationship, to a slide plate having a keyway for receiving the input shaft for the magneto. The eccentric relationship is created by the rotor shaft and magneto shaft having different axises of rotation. The eccentric relationship causes the distributor lead of the magneto to travel at varying speeds along its rotation, allowing an automotive magneto with evenly spaced distributor contact leads to be used in the ignition system of a motorcycle having timing angles which do not correspond to the evenly spaced contact leads of the distributor portion of the magneto.

14 Claims, 3 Drawing Sheets

Fig1
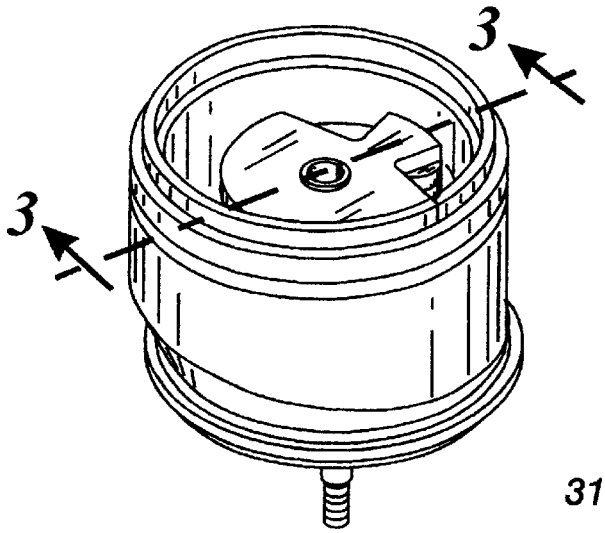
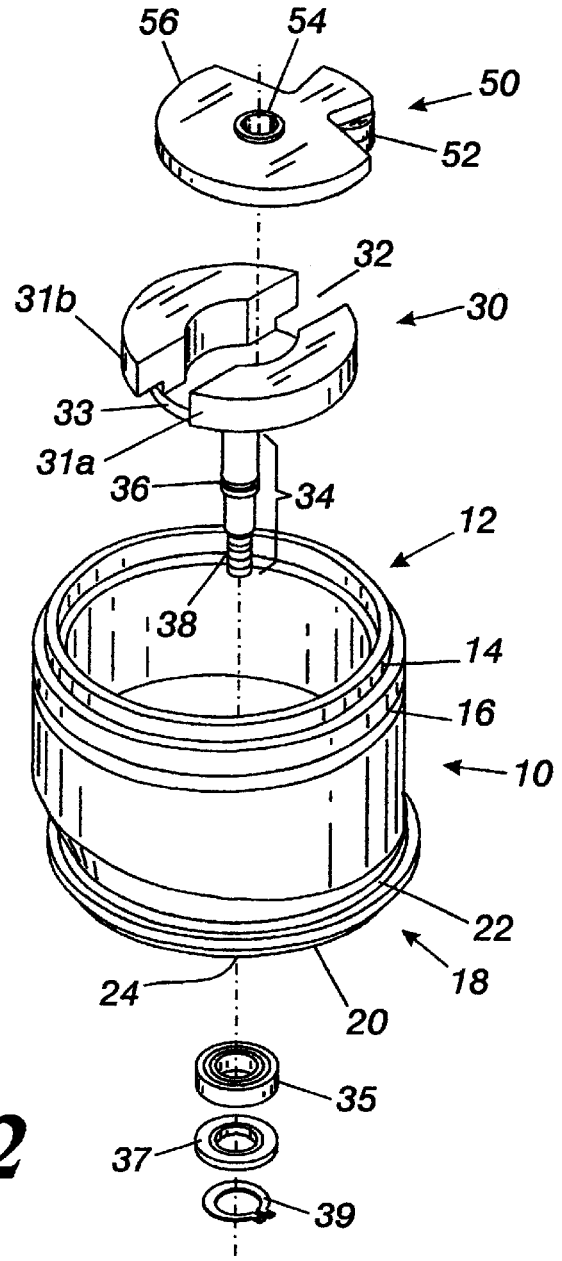
Fig2

DRIVE ADAPTER FOR A GENERATOR/ MAGNETO

FIELD OF THE INVENTION

The present invention relates to a drive adapter for a generator-magneto ("magneto") and, more particularly to an adapter for a magneto which adapts an automobile magneto for use on a motorcycle.

BACKGROUND

A magneto is an electromechanical device used as part of the ignition system for a motor vehicle. The magneto generates electrical energy based on the rotation of the engine. The electrical energy is then supplied to an ignition component, typically a spark plug, which ignites a fuel and air mixture within a cylinder of the engine.

A magneto consists of two main portions, a generating portion and a distributor portion. The generator portion of the magneto is built around a central generator shaft which is connected to an engine crankshaft in such manner that the generator shaft turns in proportional relationship to the crankshaft. Rotation of the shaft within the generator portion of the magneto causes permanent magnets to move in relation to windings of wire, thereby producing an electric current. After electricity is produced, it may be passed through additional coils of wire ("coils") which increase the voltage of the generated electricity. The coils are connected to the distributor portion of the magneto, allowing high voltage electricity to pass to the distributor portion.

The distributor portion is also built around a central shaft which turns in proportional relation to the crankshaft of the engine. A rotating distributor lead within the distributor portion of the magneto is supplied with high voltage electricity from the coils. As the distributor lead rotates within the distributor portion, the lead encounters electrical contacts placed along the circumference of the circle defined by the rotation of the distributor lead. As the distributor lead encounters each electrical contact, the lead imparts high voltage electricity to each respective electrical contact. Each electrical contact is typically connected to an ignition source, such as a spark plug, within the cylinder of a motor engine. The voltage supplied to the electrical contact by the passing distributor lead causes an electrical arc within the attached spark plug that ignites the fuel and air mixture within the cylinder of an internal combustion engine. The electrical contacts are arranged around the circumference of the distributor portion so that the contact of the distributor lead with a particular electrical contact corresponds to the proper time for ignition of the spark plug to which that particular electrical contact is connected. For instance, a magneto engineered for an eight cylinder automotive engine with the eight cylinders firing at regular intervals would have eight electrical contacts evenly spaced at 45 degree intervals around the circumference of the distributor portion. Thus, one complete turn of the distributor portion of the magneto would fire all eight cylinders of the motor engine. As used herein "automotive" refers to a vehicle having four or more wheels.

Magnetos are often used with racing or other high performance automotive engines. High performance engines, producing very high output, utilize fuel and air mixtures which are very "rich", having a much larger ratio of fuel to air than conventional automotive engines. In order to effectively and reliably ignite the mixture rich with gasoline, nitromethane, or other fuel, the ignition system must supply a tremendous amount of energy to the fuel and air mixture.

Typical battery-based ignition systems do not meet the needs of high performance engines. Battery-based ignition systems do not provide the high power electrical energy required for high performance engines, and such systems also require that large and heavy batteries be carried by the vehicle.

Magneto-based ignition systems provide many advantages over traditional battery-based ignition systems. All of these advantages are seemingly equally applicable to motorcycles engines, a motorcycle engine being fundamentally the same as an automobile engine, though smaller and with fewer cylinders. Motorcycle racers and enthusiasts have many of the same concerns as their automobile racing colleagues.

Use of a magneto-based ignition system with a motorcycle engine would provide many benefits to the performance of a motorcycle. As mentioned above, a magneto is capable of producing tremendous electrical energy to ignite very rich fuel/air mixtures which are not properly ignited by battery-based ignition systems. Also, the magneto-based ignition system is considered to be more reliable than a battery-based ignition system because of a lower likelihood of faulty or shorted wiring. Also, performance of a motorcycle with a magneto-based ignition system is improved because the motorcycle does not have to carry a large and heavy battery for the battery-based ignition system.

Use of a magneto-based ignition system for a high performance motorcycle engine greatly increases the safety of the motorcycle engine. High performance motorcycle engines operate at extremely high compression, with timing and ignition being extremely important to the operation of the engine. A misfire, a condition in which the fuel/air mixture within the cylinder fails to properly ignite, within such a high performance engine results in damage to the motor engine or even explosion of the engine. For these reasons, use of a magneto-based ignition system, having a more reliable ignition, provides a great improvement in safety to the rider of a high performance motorcycle. However, motorcycle engines, particularly two cylinder motorcycle engines, have timing angles that do not correspond with automotive magnetos.

What is needed is an apparatus that allows the use of a high performance automotive magneto with a two cylinder motorcycle engine.

SUMMARY OF THE INVENTION

The invented drive adapter allows the use of an automotive magneto with a two cylinder motorcycle engine. The adapter is connectable to the crankshaft of a motorcycle and to the shaft of a standard automotive magneto. The adapter alters the angular velocity of the magneto shaft with respect to the crank shaft so that the distributor portion of the magneto correctly corresponds to the timing of ignition required by the motorcycle engine. The adapter accomplishes this goal by having a rotating input component connected to a rotating output component, the input and output components rotating in parallel planes of rotation but having eccentric centers of rotation.

The effect of the eccentric centers, which are connected within the invented adapter, is that the angular velocity of the magneto shaft, which is connected to the distributor lead, varies with respect to the speed of the crankshaft. The variation in angular velocity allows the distributor lead of the magneto to contact the evenly spaced electrical contacts of the distributor portion of the magneto at time intervals which are not evenly spaced, thereby allowing the use of an automotive magneto with a two cylinder motorcycle engine having a timing angle which does not correspond to the evenly spaced electrical contacts of an automotive magneto.

OBJECTS OF THE INVENTION

The principal object of this invention is to provide a drive adapter which allows the use of a high performance automotive magneto with a two cylinder motorcycle engine.

Another object of this invention is to provide a drive adapter which adjusts the rotation of a high performance automotive magneto to match the timing required by a two cylinder motorcycle engine.

Another object of this invention is to provide a drive adapter allowing the use of a high performance automotive magneto with a two cylinder motorcycle engine, providing the motorcycle with more reliable ignition, which avoids misfires and protects the motorcycle rider by lowering the likelihood of engine explosion.

BRIEF DESCRIPTION OF THE DRAWINGS

The foregoing and other objects of the invention will become more readily apparent by referring to the following detailed description and the appended drawings, in which:

FIG. 1 is an isometric view of a drive adapter in accordance with the present invention.

FIG. 2 is a exploded view of the drive adapter shown in FIG. 1.

DETAILED DESCRIPTION

The invented drive adapter allows the use of an automotive generator/magneto ("magneto") with a two cylinder motorcycle engine. The adapter is connectable to the crankshaft of a motorcycle and the input shaft of a standard magneto. The adapter alters the angular velocity of the magneto shaft so that the distributor portion of the magneto will correctly correspond to the timing of ignition required by the motorcycle engine. This is made possible by the adapter having a rotating input component and a rotating output component, the input and output components rotating in parallel planes of rotation but having eccentric centers of rotation.

Figure 3:
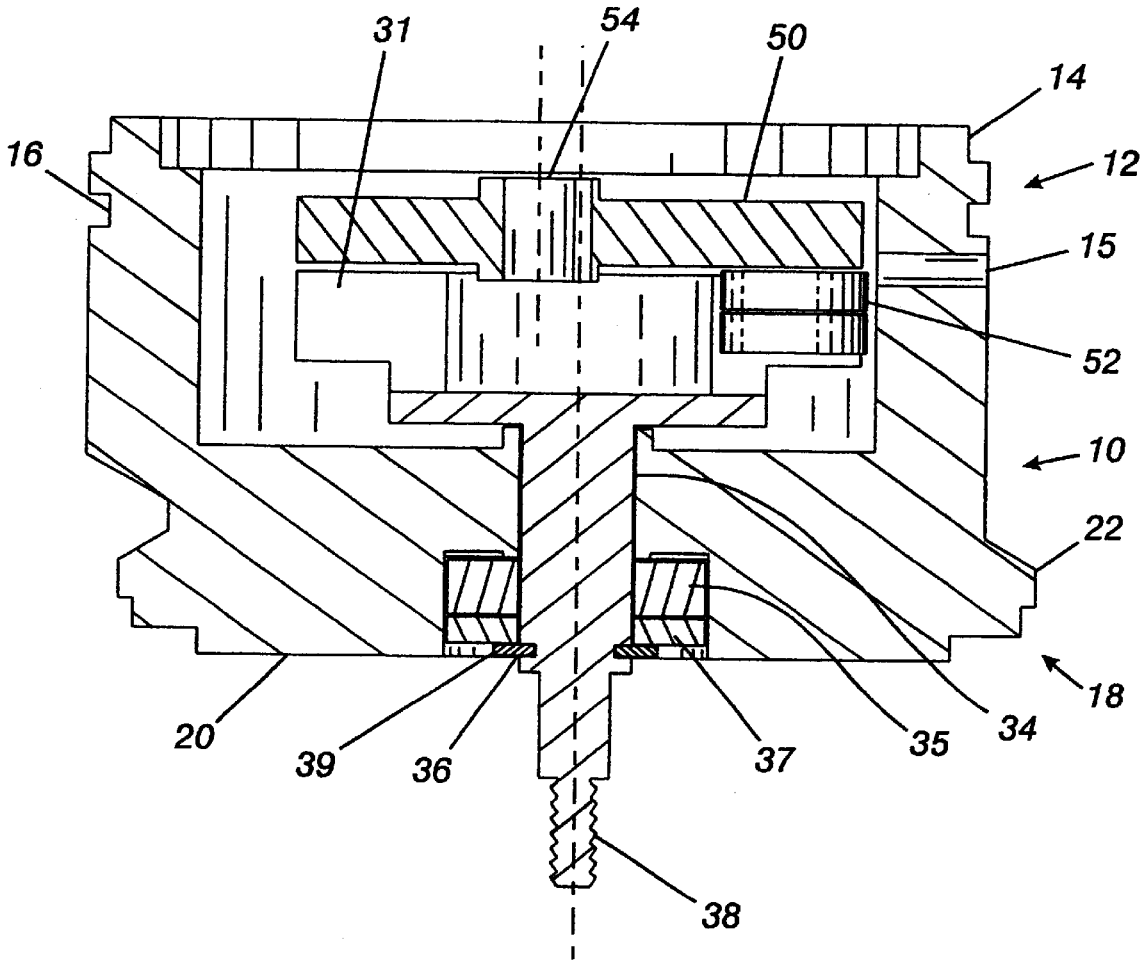
FIG. 3 is a cross section view of the drive adapter shown in FIG. 1.

Referring now to FIGS. 1, 2 and 3, a drive adapter in accordance with this invention has three main parts: a housing 10, a rotor 30, and a slide plate 50. FIG. 1 is an isometric view of a drive adapter in accordance with the present invention, FIG. 2 is a exploded view of the drive adapter shown in FIG. 1, and FIG. 3 is a cross section view of the drive adapter shown in FIG. 1. The housing 10 contains the rotor 30 which is coupled to the slide plate 50.

The main housing 10 is a generally cylindrical shell having a smooth inner and outer surface. The housing 10 has an upper portion 12 and a lower portion 18. The upper portion 12 and the lower portion 18 are both cylindrical. The centerlines of the cylinders formed by the upper portion 12 and the lower portion 18 are parallel, however the upper portion 12 and the lower portion 18 are offset from one another such that they are not coaxial.

The upper portion 12 of the main housing 10 defines a radial groove 16 upon the outside surface of the housing 10. The upper portion 12 of the housing 10 also has a lip 14 along the top edge of the upper portion 12, the lip 14 having an internal diameter greater than the rest of the upper portion 12 and having an external diameter less than the external diameter of the upper portion 12. The radial groove 16 and the lip 14 are connection points for a standard automotive magneto. The upper portion 12 of the housing 10 also defines a small pressure release hole 15, shown in FIG. 3. The pressure release hole 15 allows air pressurized by heat generated during use of the adapter to escape the adapter, preventing seal failure due to excess pressure within the adapter.

The lower portion 18 of the main housing 10 has a raised edge 22 extending outwardly from the outer surface of the lower portion 18. The raised edge 22 is a connection point, used in connecting the adapter to the frame of a motorcycle. The lower portion 18 is capped by a flat bottom surface 20. The bottom surface 20 defines a hole 24 located at the center point of the cylinder defined by the lower portion 18.

The housing 10 is connected to a rotor 30. The rotor 30 has a generally circular disk base 33. The base has two raised portions 31A, 31B which define a slot 32. The rotor 30 has a cylindrical shaft 34 extending downwardly from the base 33, the shaft 34 defining a radial clip groove 36 around the external surface of the shaft 34 and threads 38 at the end of the shaft 34. The rotor 30 resides within the housing 10 with the shaft 34 extending through the hole 24. The shaft 34 is connected to a roller bearing 35 which is held inside the housing 10 by a washer 37. A clip ring 39 is connected to the clip groove 36 which rotatably connects the rotor 30 to the housing 10 such that the lower portion of shaft 34 and threads 38 extend through the hole 24 on the outside of the housing 10.

A slide plate 50 is connected to the rotor 30. The slide plate 50 is substantially flat with a smooth lower surface. The slide plate 50 defines a keyway 54 passing through the slide plate 50, the keyway 54 having a centerline perpendicular to the substantially flat body of the slide plate 50. Roller bearings 52 are attached to the slide plate 50 such that the axis of rotation of the bearings 52 is parallel to the centerline of the keyway 54. The slide plate 50 has an extended flange 56 coplanar with the substantially flat slide plate 50. The slide plate 50 is interconnected with the rotor 30 by resting the flange 56 upon raised portions 31A, 31B, with the roller bearings 52 placed within the slot 32.

In use, the invented adapter is connected to a magneto and the body of the magneto is affixed to the adapter by connection with the groove 16 and the lip 14. Once connected, the body of the magneto will be aligned with the cylinder formed by the upper portion 12 of the housing 10. When the magneto is connected to the adapter, the input shaft of the magneto extends into housing 10 and into keyway 54 such that the input shaft of the magneto is rotatably fixed to the slide plate 50 by the keyway 54. As the attached magneto is in alignment with the upper portion 12 of the housing 10, the input shaft from the magneto holds the keyway 54 on the centerline of the cylinder formed by the upper portion 12. Note that since the rotor 30 is positioned at the centerline of the lower section 18, and since the keyway 54 and the input shaft of the magneto are positioned at the centerline of the upper portion 12, the adapter shaft 34 and the attached magneto shaft are not in axial alignment.

In use, the housing 10 of the invented drive adapter is connected to the frame of a motorcycle. The shaft 34 with threads 38 is connected to the crankshaft of the motorcycle by belt, chain, gear, or otherwise. Preferably, the adapter will be attached to the crankshaft such that the rotor 30 makes one revolution per every two revolutions of the crankshaft. The rotor 30, connected to the crankshaft by the shaft 34, turns in direct proportion to the rotation of the crankshaft. As the rotor 30 turns, the raised portions of the rotor 31A, 31B exert directional force upon the roller bearings 52 which reside within the slot 32. The slide plate 50, which is attached to the bearings 52, then revolves around the keyway 54. The magneto shaft, which is rotatably connected to the keyway 54, rotates with the slide plate 50.

The difference between the first axis of rotation, which is the centerline of the cylinder formed by the lower housing portion 18, and the second axis of rotation, which is the centerline of the cylinder formed by the upper housing portion 12, within the invented adapter causes an eccentric effect, whereby the rotor 30 and the offset slide plate 50 rotate at different angular velocities during portions of their respective rotations. The eccentric effect caused by the two axises cause the slide plate 50 to rotate at a higher angular velocity than the rotor 30 during a portion of the rotation but lower angular velocity than the rotor 30 during a second portion of the rotation. The average angular velocity of the rotor 30 will always remain equal to twice the average angular velocity of the motorcycle crankshaft. The repeated variations in angular velocity allows timing to be adjusted such that a standard automotive generator/magneto may be used with a two cylinder motorcycle engine.

Figure 4:
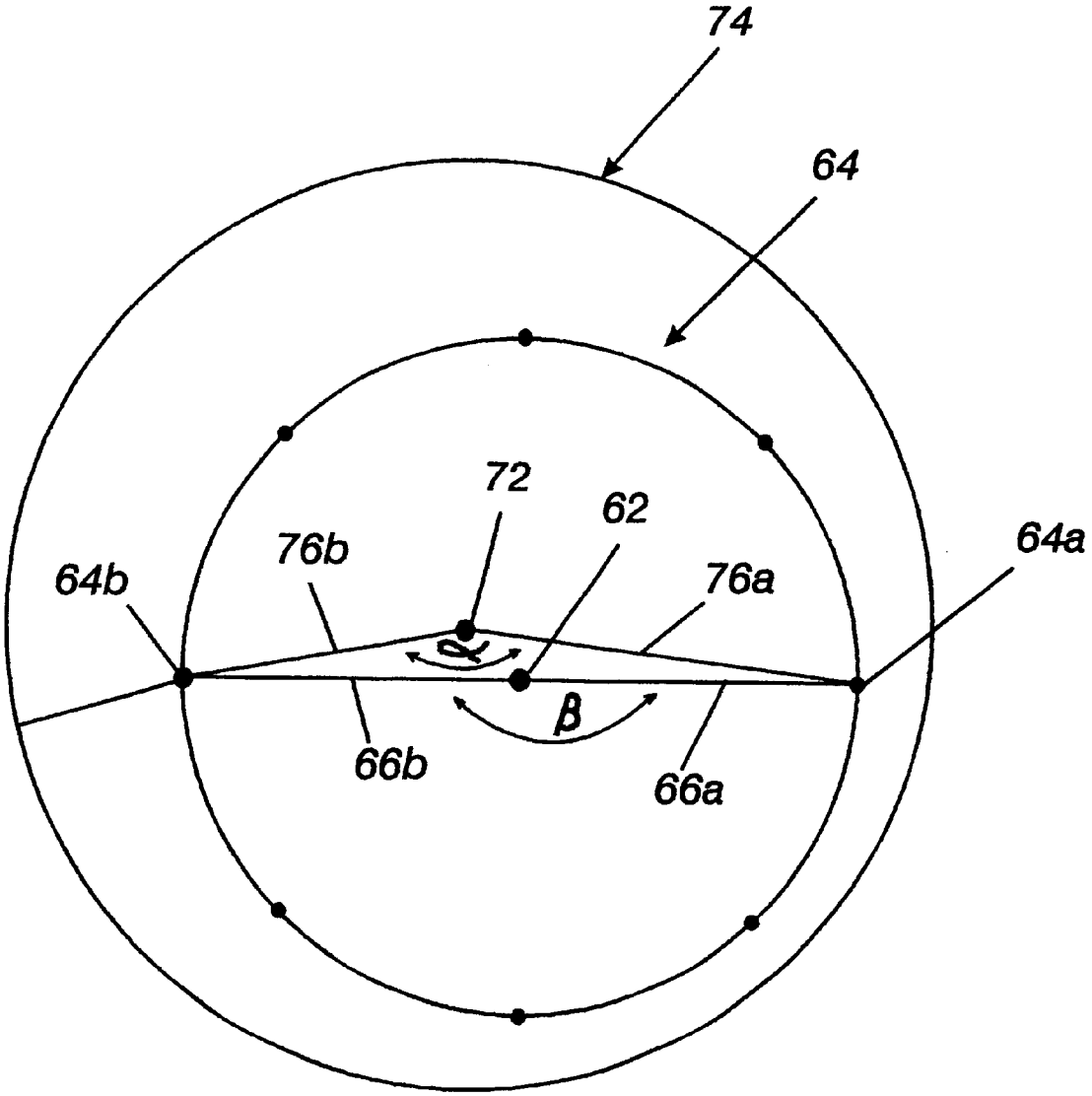
FIG. 4 is a graphical representation of the operation of the drive adapter in accordance with the present invention.

FIG. 4 shows a graphical representation of the action of the drive adapter in use. For ease of comparison, a Table 1 is provided below detailing which components of the drive adapter are represented by the graphical representations in FIG. 4.

TABLE 1

| Actual component or action | Graphical representation |
|---|---|
| centerline of rotor 30 | rotor point 72 |
| arc defined by the rotation of rotor 30 | circle 74 |
| centerline of keyway 54 | keyway point 62 |
| path defined by movement of roller bearings 52 | circle 64 |
| an initial angular position ofrotor 30 | slot line 76a |
| a second angular position ofrotor 30 | slot line 76b |
| difference between initial and second angular position of rotor 30 | |
| location of roller bearings 52 when rotor 30 is at its initial angular position | point 64a |
| location of roller bearings 52 when rdtor 30 is at its second angular position | point 64b |
| fixed distance between keyway 54 and roller bearings 52 at initial angular position of rotor 30 | bearing line 66a |
| fixed distance between keyway 54 and roller bearings 52 at second angular position of rotor 30 | bearing line 66b |
| change in angular position of roller bearings 52 with respect to keyway 54 corresponding to the difference between the initial and second angular position of rotor 30 | β |

The eccentric effect caused by the two axises of rotation within the adaptor during operation of the adapter is illustrated in FIG. 4. A circle 74 represents the path defined by the rotation of the rotor 30, with a rotor point 72 indicating the axis of rotation of the rotor 30. A bearing circle 64 represents the path of the roller bearings 52 as the roller bearings 52 rotate around the centerline of the keyway 54, indicated as a keyway point 62. A bearing line 66, extending between the keyway point 62 and the bearing circle 64, indicates the fixed distance between the centerline of the keyway 54 and the roller bearings 52. The linear slot 32 is indicated by a slot line 76, extending from the rotor point 72 to the defined circle 74.

As the rotor 30 of the adapter rotates, the slot line 76 rotates by angle α, from an initial position 76*a* to a second position 76*b*. The slot line 76 corresponds to a position upon the bearing circle 64 at every position during rotation because the roller bearings 52 are slidably fixed within the linear slot 32. Angular rotation αof the slot line 76 therefore corresponds with angular rotation β of the bearing line 66, from an initial position 66*a* to a second position 66*b*. Thus, a change in angular position of the shaft 34 results in a related, but non-identical change in angular position of the slide plate 50, the keyway 54, and any magneto shaft connected thereto.

EXAMPLE AND PREFERRED EMBODIMENT

The preferred embodiment of the invented adapter has a distance from the centerline of the rotor 30 to the centerline of the keyway 54 and a distance between the centerline of the keyway 54 and the centerline of the bearings 52 which enable the adapter to convert an eight cylinder automotive magneto for use on a Harley Davidson® motorcycle engine. The adapter adjusts the angular velocity of the connected magneto shaft such that the timing of the distributor portion of the magneto provides an ignition charge to each of the two cylinders of a motorcycle in proper relationship to one another.

The two cylinders of a Harley Davidson® engine oppose one another by 45°. The 45° arrangement corresponds to an engine timing angle of 157.5°. In other words, when a complete combustion cycle of the engine is represented by a 360° circle, one cylinder ignites at 0°/360° and the other at 157.5°, with one ignition per cylinder for every 360° of revolution. So, a distributor having a contact lead which makes one revolution for every two revolutions of the crankshaft must ignite the first cylinder at the engine position of 0°/360°, the second cylinder at the engine position of 157.5°, the first cylinder again at the engine position of 0°/360°, and so on.

The distributor portion of a standard eight cylinder automotive magneto has electrical contacts arranged in 45° increments from 0° to 360°, with no contact point corresponding to the 157.5° timing angle required by the motorcycle engine. The invented adapter adjusts the speed of rotation of the magneto shaft so that the automotive magneto is compatible with the 157.5° timing angle required by the motorcycle engine. The eccentric rotation of the invented adapter causes a connected magneto shaft, and therefore the distributor lead of the magneto to rotate at a rate greater than the angular velocity of the adaptor shaft 34 between the 0°/360° position of the distributor and the 180° position of the distributor. The magneto shaft and distributor lead then travel at an angular velocity less than the angular velocity of the adaptor shaft 34 between the 180° position of the distributor and the 0°/360° position of the distributor.

In use, the number 1 and 2 cylinders of the Harley Davidson® engine are fired from the number 1 and number 5 electrical contacts of the eight cylinder automotive magneto, the 1 and 5 distributor positions corresponding to the 0°/360° position of the distributor and the 180° position of the distributor, respectively.

The preferred drive adapter, with internal distances between the rotor 30 and the keyway 54 centerlines and between the keyway 54 and the roller bearings 52 centerlines, causes a 180° revolution of the rotor 30 to result in a 157.5° rotation of the slide plate 50 and the keyway 52 at some point during rotation of the rotor 30. Since the connected magneto shaft, using the preferred drive adapter, is moving at a higher angular velocity than the adapter shaft 34 between the 0°/360° distributor position and the 180° distributor position, the distributor lead of the magneto reaches the 180° distributor position (electrical contact number 5) when the adapter shaft 34, the motorcycle crankshaft, and the motorcycle engine are in the 157.5° timing position. Thus, the adapter fires the electrical contact on the distributor at 180° when the timing position of the engine is actually 157.5°.

The eccentric action within the adapter then slows the rotation of the magneto shaft below the angular velocity of the adapter shaft 34 such that the first cylinder is fired by the distributor lead at 0°/360° of the distributor, when the motorcycle engine is at the 0°/360° timing position. In this manner, a Harley Davidson® engine can be properly fired at engine timing positions of 0°/360° and 157.5° by using the invented adapter and an eight cylinder automotive magneto having electrical contacts at positions 1 and 5 of its distributor portion, corresponding to 0°/360° and 180° distributor angles respectively.

Referring to FIG. 4, in the preferred embodiment of the invented adapter, at some point in the rotation of the rotor 30, angle $\alpha$ equals 157.5° when angle $\beta$ equals 180°. The eight points evenly spaced about the bearing circle 64 indicate the location of the eight firing positions of the distributor portion of an eight cylinder automotive magneto. The initial point 64a indicates the 0°/360° timing position of the motorcycle engine and the 0°/360° position of the distributor. As the engine timing position and the rotor 30 position reach an angle $\alpha$ of 157.5°, which corresponds to the point 64*b*, the distributor timing position reaches an angle $\beta$ of 180°. Thus, the second cylinder of the motorcycle engine fires with the engine in the 157.5° timing position and the distributor in the 180° timing position. Note, upon one complete revolution of the adapter, the timing angle of the engine and timing angle of the distributor will again be 0°/360°, firing the first cylinder.

SUMMARY OF THE ACHIEVEMENT OF THE OBJECTS OF THE INVENTION

From the foregoing, it is readily apparent that I have invented an improved apparatus which allows the use of a high performance automotive magneto with a two cylinder motorcycle engine, adjusts the rotation of an automotive magneto to match the timing required by a two cylinder motorcycle engine, and allows the use of a high performance automotive magneto with a two cylinder motorcycle engine, providing the motorcycle with more reliable ignition, which avoids misfires and protects the motorcycle rider by lowering the likelihood of engine explosion.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A drive adapter for connection between a crankshaft of a motorcycle and an input shaft of an automotive generator/magneto, said adapter capable of adapting the automotive generator/magneto for use in an ignition system of the motorcycle, said adapter comprising:

a rotor having a first axis of rotation;

a slide plate having a second axis of rotation, said second axis of rotation being parallel to, but different from said first axis of rotation; and, a main connection means connecting said rotor with said slide plate such that rotation of said rotor causes rotation of said slide plate;

wherein the crankshaft of the motorcycle is connectable to said rotor of said adapter, and wherein said slide plate is connectable to the input shaft of the automotive generator/magneto.

2. A drive adapter in accordance with claim 1, wherein said connection means is fixedly connected to said slide plate, and wherein said connection means is rotatably fixed to said rotor, but slidable along the radial direction of said rotor.

3. A drive adapter in accordance with claim 1, wherein said connection means is fixedly connected to said rotor, and wherein said connection means is rotatably fixed to said slide plate, and said connection means is slidable along the radial direction of said slide plate.

4. A drive adapter in accordance with claim 2, wherein said rotor has a crankshaft connection means and said slide plate has a generator/magneto shaft connection means.

5. A drive adapter in accordance with claim 4, wherein said main connection means is at least one roller bearings, said bearings rotating in a plane parallel to the plane of rotation of said slide plate.

6. A drive adapter in accordance with claim 5, wherein said rotor comprises:

a body portion having a linear slot extending from said first axis of rotation to the outer edge of said body portion; and a shaft portion extending from said body portion to said crankshaft connection means.

7. A drive adapter in accordance with claim 6, wherein said slide plate is substantially flat, and wherein said generator/magneto shaft connection means is a keyway formed in said slide plate, said keyway being perpendicular to the plane of rotation of said slide plate and having said second axis of rotation.

8. A drive adapter in accordance with claim 7, further comprising:

a cylindrical housing having a lower portion and an upper portion, said lower portion having a first centerline and said upper portion having a second centerline, said portions offset from one another such that said centerlines of said portions are parallel but not the same, said housing having a bottom surface perpendicular to said centerlines, said first centerline coaxial with said first axis of rotation, said second centerline coaxial with said second axis of rotation, said rotor rotatably connected to said bottom surface of said housing.

9. A drive adapter in accordance with claim 8, wherein said linear slot of said rotor is defined by two symmetrical and opposed raised sections extending from said body portion.

10. A drive adapter in accordance with claim 9, wherein said slide plate rests upon said raised sections, and said roller bearings are disposed within said linear slot.

11. A drive adapter in accordance with claim 10, wherein said keyway is substantially cylindrical, said slide plate further defining a single squared notch extending the length of the keyway.

12. A drive adapter in accordance with claim 11, wherein said cylindrical housing defines a small hole, said hole extending from the inside surface of said housing to the outside surface of said housing.

13. A drive adapter in accordance with claim 12, wherein said crankshaft connection means is a threaded end portion.

14. A drive adapter in accordance with claim 13, further comprising a main bearing; wherein said rotor is attached to said main bearing, and said main bearing is attached to said bottom surface of said housing.

* * * * *